US007524337B2

(12) United States Patent
Rosc et al.

(10) Patent No.: US 7,524,337 B2
(45) Date of Patent: Apr. 28, 2009

(54) METHOD FOR THE MANUFACTURE OF ELECTRICAL COMPONENT

(75) Inventors: Friedrich Rosc, Österreich (AT); Ingrid Rosc, legal representative, Österreich (AT); Berrit Ines Rosc, legal representative, Österreich (AT); Jördis Brit Rosc, legal representative, Österreich (AT); Franz Schrank, Österreich (AT); Gerald Kloiber, Österreich (AT)

(73) Assignee: EPCOS AG (DE)

( * ) Notice: Subject to any disclaimer, the term of this patent is extended or adjusted under 35 U.S.C. 154(b) by 198 days.

(21) Appl. No.: 11/697,844

(22) Filed: Apr. 9, 2007

(65) Prior Publication Data

US 2007/0175019 A1 Aug. 2, 2007

Related U.S. Application Data

(62) Division of application No. 10/240,300, filed on Mar. 3, 2003, now Pat. No. 7,215,236.

(51) Int. Cl.
*H01C 17/245* (2006.01)

(52) U.S. Cl. ..... 29/25.03; 338/25; 338/205; 264/616; 264/618

(58) Field of Classification Search ..... 29/25.03; 338/25, 31, 205; 264/616, 618
See application file for complete search history.

(56) References Cited

U.S. PATENT DOCUMENTS 4,146,957 A * 4/1979 Toenshoff ..... 29/612
4,290,041 A * 9/1981 Utsumi et al. ..... 338/21
4,786,888 A 11/1988 Yoneda et al.
4,951,028 A * 8/1990 Tuller ..... 338/22 R
5,500,996 A * 3/1996 Fritsch et al. ..... 29/612
5,703,000 A 12/1997 Nakayama et al.
6,078,250 A * 6/2000 Ueda et al. ..... 338/313
6,498,068 B1 * 12/2002 Ueda et al. ..... 438/385
6,639,506 B1 * 10/2003 Landis ..... 338/25
7,161,463 B2 * 1/2007 Kawaguchi et al. ..... 338/314
2003/0048190 A1 * 3/2003 Landis et al. ..... 340/603
2003/0062984 A1 * 4/2003 Ito et al. ..... 338/25

(Continued)

FOREIGN PATENT DOCUMENTS

DE 2 321 478 11/1973

(Continued)

OTHER PUBLICATIONS

Phillippow Egen: Taschenbuch Elektrotechnik Band 1 Carl Hanser Verlag München Wien 1986.

(Continued)

*Primary Examiner*—George Fourson
(74) *Attorney, Agent, or Firm*—Schiff Hardin LLP

(57) ABSTRACT

An electrical component having a base body includes a layer stack of mutually overlapping, electrically conductive electrode layers that are separated from one another by electrically conductive ceramic layers. The electrically conductive ceramic layers are composed of a ceramic whose specific electrical resistance exhibits a negative temperature coefficient. The electrically conductive ceramic layers are produced of ceramic green films that are sintered in common with the electrode layers, and outside electrodes that are electrically conductively connected to the electrode layers are arranged at two opposite outside surfaces of the base body. A method for the manufacture of the component and to the employment of the component is also provided.

3 Claims, 2 Drawing Sheets

U.S. PATENT DOCUMENTS

| | | | | |
|---|---|---|---|---|
| 2007/0008062 | A1 * | 1/2007 | Fivas et al. | 338/25 |
| 2007/0242416 | A1 * | 10/2007 | Saito et al. | 361/321.1 |

FOREIGN PATENT DOCUMENTS

| | | | |
|---|---|---|---|
| DE | 36 25 265 | A1 | 2/1988 |
| DE | 37 25 455 | A1 | 2/1989 |
| DE | 44 20 657 | A1 | 12/1995 |
| DE | 198 35 443 | A1 | 3/1999 |
| JP | 01171201 | A * | 7/1989 |

OTHER PUBLICATIONS

Japanese Patent Abstract, Publication No. 04247603 A, Date of Publication: Sep. 3, 1992.
Japanese Patent Abstract, Publication No. 02276203 A, Date of Publication: Nov. 13, 1990.
Japanese Patent Abstract, Publication No. 09007803 A, Date of Publication: Jan. 10, 1997.

* cited by examiner

METHOD FOR THE MANUFACTURE OF ELECTRICAL COMPONENT

CROSS REFERENCE TO RELATED APPLICATION

The present application is a Divisional Application of patent application Ser. No. 10/240,300, filed Mar. 3, 2003, now U.S. Pat. No. 7,215,236 which is incorporated herein by reference.

BACKGROUND OF THE INVENTION

1. Field of the Invention

The present invention relates generally to an electrical component having a base body and two outside electrodes, whereby the base body contains a ceramic having a prescribed, specific resistance. The invention is also directed to a method for the manufacture of the electrical component. Over and above this, the invention is directed to the employment of the electrical component.

2. Description of the Related Art

Electrical components of the type described above are known wherein the specific resistance of the ceramic exhibits a negative temperature coefficient and that, consequently, are employed as an NTC (Negative Temperature Coefficient) resistor. Low values of resistance between 50 and 500 Ohms are demanded for the components for specific applications of the NTC resistors, for example in heating technology, industrial electronics or motor vehicle electronics. The resistance of an NTC component is usually recited at 25° Celsius.

Ceramics that comprise a low specific resistance are available for realizing components having the desired, low values of resistance. These ceramics are based on mixed crystals having a spinel structure that are composed of four cations of the group manganese, nickel, cobalt and copper. The cations are mixed with one another in an atomic ratio Mn/Ni/Co/Cu that lies between 65/19/9/7 and 56/16/8/20. The specific resistance of these ceramics lies between 100 and 0.1 Ωcm.

These ceramics have the disadvantage that their resistance is subject to great variation. Further, these ceramics have the disadvantage that their electrical properties, particularly their electrical resistance, are not stable over the long term. The long-term stability of the components is recited as the change in the resistance after storing the components at, for example, a temperature of 70° Celsius over a time span of 10,000 hours. The time-conditioned change in the resistance under these conditions is greater than 2% given the components produced with low-impedance ceramics.

The known components also have the disadvantage that their resistance—due to the simple design (ceramic block or wafer with two outer contact electrodes)—is exclusively dependent on the specific resistance of the ceramic and is therefore subject to corresponding fluctuations in the composition of the ceramic material. The manufacture-conditioned deviation of the actual resistance from the rated resistance can amount to 5% or more.

The German Patent publication DE 2321478 discloses an NTC resistor (thermistor) that comprises a multi-layer structure, whereby electrode layers are separated from one another by ceramic layers. The ceramic layers are thereby printed on the electrode layers with silk-screening as thick-film layers. As a result of the silk-screening process that is employed, the ceramic layers exhibit high variation with respect to their layer thickness, so that the thermistors disclosed by the publication can only be manufactured with exactly prescribed values of resistance with considerable difficulty. The known thermistors thus exhibit wide tolerances with respect to the electrical resistance.

Due to these wide variation in values and the low long-term stability, the known low-impedance NTC resistors are only suited for applications wherein low demands are made of the component tolerances and component stability. For example, the manufacture of making current limiters is one such application.

Further, the combination of a high B-value and low R-value cannot be physically realized.

SUMMARY OF THE INVENTION

The present invention provides an electrical component that is suited as an NTC resistor and that comprises a low value of resistance given great long-term stability and low variation of the values of resistance. The invention also provides a method for the manufacture of the electrical component that enables the optimally exact setting of a rated resistance of the component.

The invention provides an electrical component having a base body that comprises a layer stack of mutually overlapping, electrically conductive electrode layers. Two respective neighboring electrode layers are separated from one another by an electrically conductive ceramic layer. The electrically conductive ceramic layers are composed of a ceramic material whose specific electrical resistance ρ (T) exhibits a negative temperature coefficient. The electrically conductive ceramic layers are produced of ceramic green films that are sintered in common with the electrode layers. Over and above this, outside electrodes that are electrically conductively connected to the electrode layers are arranged at two opposite outside surfaces of the base body.

BRIEF DESCRIPTION OF THE DRAWINGS

The invention is explained in greater detail below on the basis of exemplary embodiments and the Figures pertaining thereto.

DETAILED DESCRIPTION OF THE PREFERRED EMBODIMENTS

Figure 1:
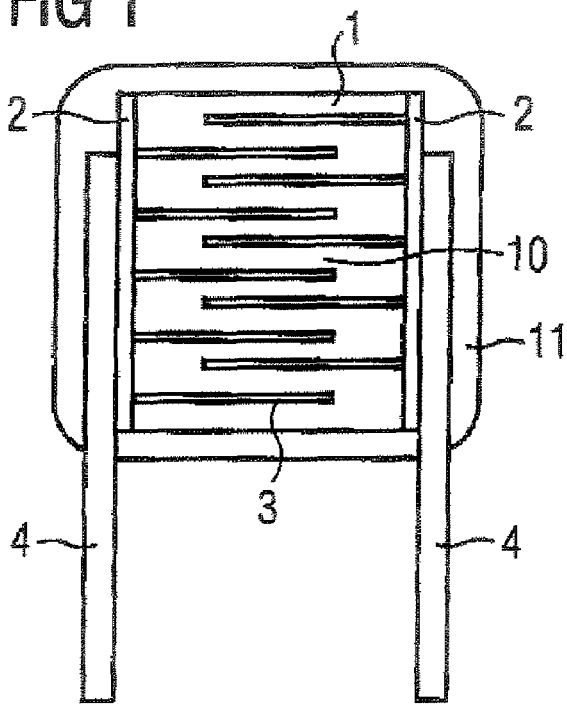
FIG. 1 is a schematic side cross-section through a component according to the principles of the present invention.

FIG. 1 shows a component according to the present invention that is a monolithic multi-layer component with a base body 1 that contains electrically conductive ceramic layers 10. The ceramic is a ceramic material whose specific resistance has a negative temperature coefficient. It is a mixed crystal with spinel structure based on $Mn_3O_4$ that also contains a nickel part. The mixing ratio of Mn/Ni amounts to 94/6. This ceramic has a high resistance of $\mathbf{10^4}$ Ωcm.

Electrode layers 3 are arranged within the base body 1, the electrode layers 3 being composed of electrically conductive precious metal layers and being separated from one another be electrically conductive ceramic layers. The thickness of the electrode layers amounts to approximately 5 μm. The resistance of the component of high-impedance ceramic is suitably reduced by the electrode layers 3, so that the component has a low Ohmic impedance of 50Ω overall. The electrode layers 3 are connected to outside electrodes 2 that are applied to the outside of the base body 1. The outside electrodes are produced by burning in a silver stoving paste. A copper wire as a lead 4 is soldered to each outside electrode 2.

For protection against moisture and other environmental influences, the component shown in FIG. 1 can also be enveloped with a plastic or lacquer layer or can also be provided with a protective envelope 11 of glass.

Figure 2:
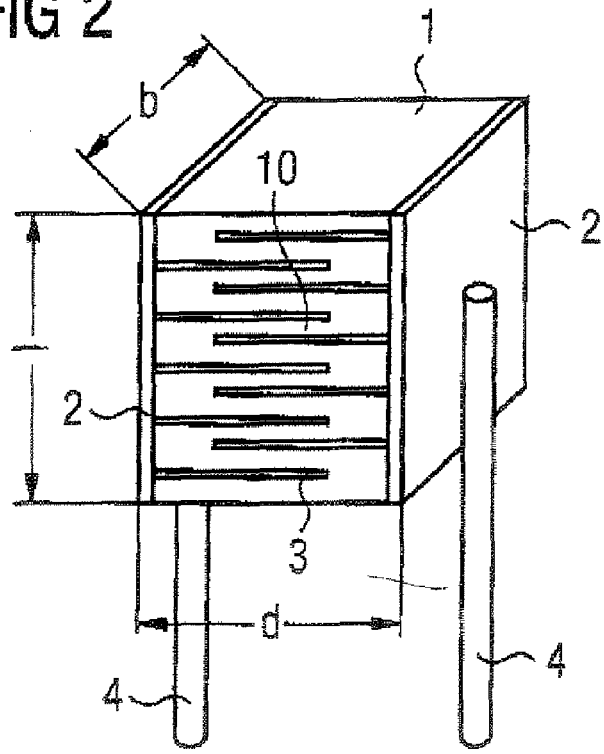
FIG. 2 is a perspective view of the inventive component.

FIG. 2 shows the component of FIG. 1 in a perspective view. The geometrical dimensions of the inventive component proceed from this view. The length 1 and the width b respectively amount to 0.5-5 mm. The thickness d amounts to 0.3-2 mm. As a result thereof that the difference between the thickness d and the width b or, respectively, the length 1 amounts to at least 0.2 mm, the component shown in FIG. 2 can be handled with systems for grabbing and conveying that have already proven themselves for other components. In other words, the present component may be used in the known pick and place devices for circuit assembly. It proceeds from the illustrated dimensions that the inventive component is particularly suited for the realization of miniaturized temperature sensors.

The stability of the electrical properties of the component shown in FIG. 2 can be documented on the basis of various testing criteria that are presented in the following Table 1.

TABLE 1

| Test | Norm | Test conditions | $\Delta R_{25}/R_{25}$ (typical) |
|---|---|---|---|
| Storage in dry heat | DIN IEC 60068-2-2 | Storing at upper category temperature<br>T: 155° C.<br>t: 1000 h | <1%/ |
| Storage given constant humidity | DIN IEC 60068-2-3 | Air temperature: 40° C.<br>Relative humidity: 93%<br>Duration: 56 days | <1% |
| Rapid temperature change | DIN IEC 60068-2-14 | Lower test temperature: −55° C.<br>Upper test temperature: 155° C.<br>Number of cycles: 10 | <0.5% |
| Long-term stability (anticipated value) | | Temperature: +70° C.<br>Time: 10,000 h | <2% |

Figure 3:
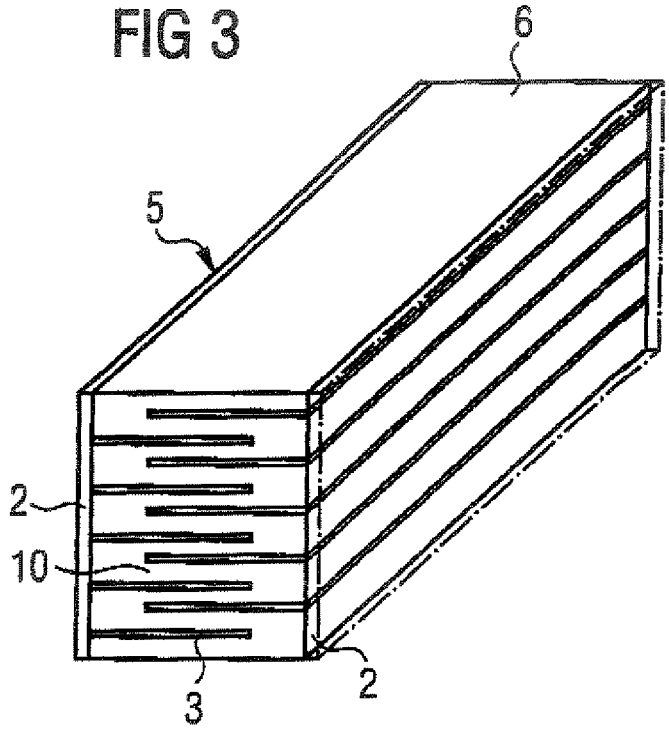
FIG. 3 is a perspective view of an inventive component that is implemented as a precursor component for the manufacture of further inventive components.

FIG. 3 shows a precursor component 5 with a bar-shaped base body 6. A respective outside electrode 2 is applied to two lateral surfaces of the bar-shaped base body 6 lying opposite one another. The electrical resistance of the precursor component 5 can be measured with the assistance of these outside electrodes 2. Electrode layers 3 are arranged in the inside of the bar-shaped base body 6, the electrode lawyers 3 reducing the electrical resistance of the precursor component and being separated from one another by electrically conductive ceramic layers 10.

The electrical properties of the precursor component 5 are uniform along the bar, i.e. each section of the bar that is the same length also exhibits the same electrical resistance. As a result thereof, the electrical resistance of the component to be manufactured can be exactly set by simply measuring off the length of a bar section.

Figure 4:
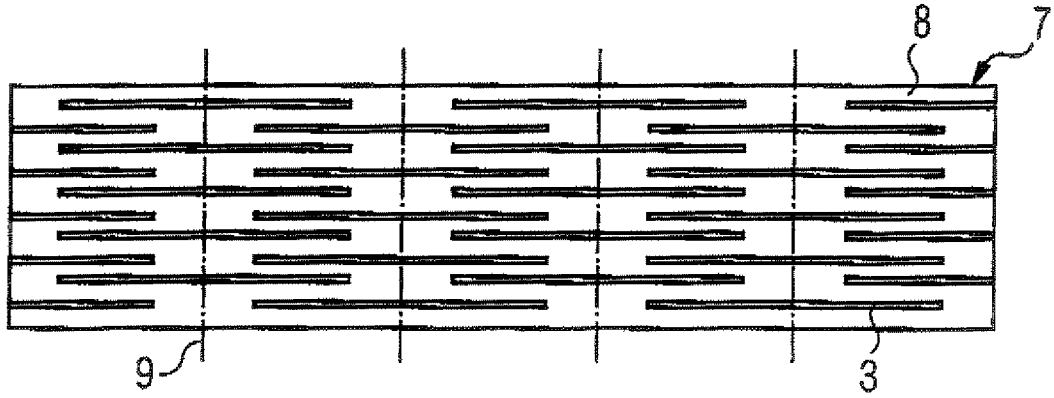
FIG. 4 is a schematic cross-section through a plate suitable for the manufacture of a precursor component.

FIG. 4 shows a plate 7 from which precursor components can be produced by punching out bars along the punch lines 9. The plate 7 has a thickness that corresponds to the length 1 of the component to be produced. The other dimensions of the plate amount to approximately 105×105 mm. The plate is composed of ceramic green films 8 lying on top of one another between which electrode layers 3 are arranged offset relative to one another. The parallel production of a great number of components with exactly defined values of resistance is possible with the assistance of the plate 7, which is first processed into precursor components and finally processed into the components themselves that are to be manufactured.

The invention is not limited to the embodiments shown by way of example but is defined in broad terms as providing an electrical component having a base body that has a layer stack of mutually overlapping, electrically conductive electrode layers that are separated from one another by electrically conductive ceramic layers, the electrically conductive ceramic layers are composed of a ceramic whose specific electrical resistance exhibits a negative temperature coefficient; the electrically conductive ceramic layers are produced of ceramic green films that are sintered in common with the electrode layers; and outside electrodes that are electrically conductively connected to the electrode layers are arranged at two opposite outside surfaces of the base body.

The invention also provides a method for the manufacture of an electrical component with a prescribed rated resistance proceeding from a precursor component having a bar-shaped base body, having outside electrodes arranged at long sides of the bar whose actual resistance measured between the outside electrodes is lower than the rated resistance, and whereby the resistance of longitudinal sections of the precursor component that are equal in length and comprise outside electrodes is of the same size, comprising the following steps: measuring an actual resistance of the precursor component;

calculating the rated length of a longitudinal section of the precursor component representing the electrical component to be manufactured that is necessary for achieving the rated resistance; and cutting off a longitudinal section having the rated length from the precursor component.

The inventive component has the advantage that the electrically conductive ceramic layers are manufactured of ceramic green films. The process of drawing ceramic green films can be utilized for producing films with a thickness of approximately 50μ upon adherence to extremely precise layer thickness prescriptions. As a result thereof, the inventive component has the advantage that a prescribed value of resistance for the component can be very exactly adhered to.

In an advantageous embodiment of the invention, further, a ceramic material for the electrically conductive ceramic layers is selected whose B-value describing the temperature curve ρ (T) of the specific electrical resistance is greater than 4000 K. The B-value describes the temperature curve ρ (T) with the following equation:

$$\rho(T)=\rho_{25}\exp(B/T).$$

$\rho_{25}$ is thereby equal to the specific electrical resistance at 25° C.

The B-value is calculated according to the following equation:

$$B=\frac{T_1\times T_2}{T_2-T_1}\times\ln\frac{R(T_1)}{R(T_2)}$$

$R(T_1)$ and $R(T_2)$ represent the resistance of the ceramic material at two different temperatures $T_1$ and $T_2$.

Ceramics with high B-values have the advantage that they exhibit a great sensitivity of the resistance dependent on the temperature, which enables the manufacture of very sensitive temperature sensors. Further, ceramic systems with high B-values have the advantage of a good long-term stability behavior of the electrical resistance.

Ceramics with high B-values, however, also have high specific resistance. By providing the electrode layers in the base body of the electrical component, the present invention makes it possible to reduce the electrical resistance of the component. This succeeds in that the parallel circuit of a plurality of high-impedance resistors is realized by means of the electrode layers. Despite the high resistance of the ceramics that are employed, thus, temperature sensors with values of resistance below 2 kΩ can be manufactured.

Further, an electrical component is advantageous wherein the base body has the shape of a cuboid. Only two lateral surfaces of the cuboid are thereby covered by the outside electrodes, whereas the four other lateral surfaces are free of electrically conductive coatings. Such a component has the advantage that the outside electrodes are exactly spatially defined and thus can not influence the electrical resistance of the component. This is a great advantage over known components wherein the outside electrodes are produced by immersion into a conductive paste and thus lie cap-like on a plurality of lateral surfaces of the base body and, therefore, edge-overlapping, as a result whereof the outside electrodes can very greatly reduce the resistance under unfavorable conditions in that they lie very close to one another when the base body is turned over.

An advantageous form of coating the base body with outside electrodes that are not edge-overlapping and that thus achieve the goal of leaving four of the lateral surfaces of the cuboid base body free of electrically conductive coatings is the employment of a silk-screening process for printing lateral surfaces of the cuboid.

Temperature sensors can thus be manufactured that simultaneously comprise a very low resistance and a high sensitivity.

Some ceramic materials whose B-value is higher than 3600 K and that are suited for employment in the inventive component are cited below:

For example, a high-impedance ceramic mixed crystal on the basis of $Mn_3O_4$ with an additive of nickel and cobalt comes into consideration, whereby the mixing ratio Mn/Ni/Co=55.6/3.4/41 applies. Such a ceramic exhibits a B-value of somewhat above 4000 K.

Further, a ceramic comes into consideration that also contains additives of nickel and titanium in addition to $Mn_3O_4$, whereby the mixing ratio Mn/Mi/Ti corresponds to the relationship 77/20/3. Such a ceramic exhibits a B-value of 4170 K.

A ceramic that also contains nickel and zinc in addition to $Mn_3O_4$ can be cited as a further example. The mixing ratio Mn/Ni/Zn is thereby equal to 64/7/29. Such a ceramic exhibits a B-value of 4450 K.

Further, a component is especially advantageous wherein the ceramic is a mixed crystal in spinel structure, perovskite or corundum structure that is produced on the basis of $Mn_3O_4$ with one or more additives selected from the elements nickel, cobalt, titanium, zirconium or aluminum. What are thereby particularly advantageous are the stable compositions that comprises a high specific resistance between $10^5$ and $10^6$ Ωcm that can be lowered to a low value with the assistance of the electrode layers.

A component on the basis of a high-impedance ceramic with a specific resistance>$10^2$ cm has the advantage that the ceramic exhibits a high long-term stability with respect to its electrical resistance.

Specifically coming into consideration as a high-impedance ceramic is, for example, a mixture on the basis of $Mn_3O_4$ with a mixing ratio Mn/Ni of 94/6. Such a ceramic exhibits a specific resistance of $10^4$ Ωcm and a B-value of 4600 K.

Another possibility is a mixture of manganese, nickel and cobalt with a mixing ratio Mn/Ni/Co of 70/20/10. This latter mixture exhibits a specific resistance of 100 Ωcm and a B-value of slightly more than 3600 K.

The arrangement of the electrodes layers suitable for reducing the resistance of the component can be advantageously realized in a component wherein each outside electrode is contacted to electrode layers in the form of planar layers lying parallel above one another. The layers contacted to an outside electrode form a comb-like electrode packet with this outside electrode. The two electrode packets respectively belonging to an outside electrode are pushed into one another in the component.

The fashioning of the inventive component with comb-like electrodes packets pushed into one another has the advantage that it can be easily realized by placing individual films or, respectively, layers on top of one another. The layers lying parallel above one another also have the advantage that the volume available in the component is optimally utilized for lowering the ohmic impedance. This derives therefrom that especially large surfaces of the respective electrode layers reside opposite one another in the comb-like arrangement. As a result thereof, the cross-section of the electrical conductor under consideration increases and its resistance, thus, decreases.

All electrode materials that are stable at the temperatures needed for the manufacture of the component are suitable for the fashioning of the electrode layers. In an especially preferred embodiment of the invention, the electrode layers are implemented in palladium or platinum or their alloys. These precious metals have the advantage that they are insensitive to electro-chemical corrosion. As a result thereof, the electrical component manufactured with them becomes insensitive to humidity or, respectively, moisture penetrating into the component from the outside.

The employment of the precious metals as the material for the electrode layers also has the advantage that the precious metals exhibit only a very slight migration tendency, so that as a result the migration of the metals into the ceramic and, thus, an uncontrollable modification of the electrical resistance of the ceramic component is prevented.

The outside electrodes can be composed of any commercially available electrode material for ceramic components. However, care must be exercised to see that a good electrical bonding to the electrode layers is assured. In an especially advantageous embodiment of the inventive component, the outside electrodes are composed of a silver or gold stoving paste. After the ceramic has been sintered together with the electrode layers, this stoving paste can be applied onto two outside surfaces of the base body and be burned in. Over and above this, it has the advantage that it is easy to solder, so that leads can be soldered to the outside electrodes. After the application of a protective lacquering or of some other envelope of suitable material, a finished sensor element is obtained with the assistance of such leads that, for example, can be copper wires.

Upon employment of Au outside electrodes and gold-coated leads, it is possible to provide the component with a protective envelope of glass.

The invention also specifies a method for the manufacture of an inventive electrical component with a prescribed rated resistance, whereby the component is manufactured proceeding from a precursor component having a bar-shaped base body. In an especially advantageous embodiment of the invention, the precursor component is manufactured by stacking ceramic green films and electrodes on top of one another and by subsequently sintering the layer stack that has arisen in this way. The precursor component comprises outside electrodes arranged at long sides of the bar, whereby that actual resistance measured between the outside electrodes of the precursor component is lower than the rated resistance of the electrical component to be manufactured. Further, the precursor component has the property that the resistances of longitudinal sections of the precursor component that are equal in length and comprise outside electrodes are of essentially the same size.

First, the actual resistance of the precursor component is measured, for example with an ohmmeter. Subsequently, the length of a longitudinal section to be cut off from the precursor component is calculated from the actual resistance. The longitudinal section of the precursor component thereby represents the electrical component to be manufactured. Finally, the longitudinal section having the previously calculated length is cut from the precursor component.

The inventive method has the advantage that the resistance of the electrical component is set only in a very late method step, at a time at which the ceramic has already been completely sintered. Slightly different geometries may thereby possibly arise in the manufacture of a plurality of identical components; this, however, is more than compensated by the great advantage of a very exactly reproducible rated resistance. Further, the inventive method has the advantage that the resistance of the ceramic is measured before the final manufacture of the component. Fabrication-conditioned fluctuations of the resistance can be compensated in this way.

As warranted, leads can also be firmly soldered to the outside electrodes after the component is cut off from the precursor component.

Moreover, the inventive method has the advantage that extremely low resistance can be exactly set in conjunction with electrode layers that reduce the resistance of the component.

Over and above this, a method is especially advantageous wherein the precursor component is manufactured of a plate that is a layer stack of ceramic green films and suitably arranged electrode layers. A suitable arrangement of electrode layers is established, for example, in that the plate is composed of a plurality of idealized bar-shaped precursor components arranged side-by-side In the manufacture of the inventive component, a bar is first punched from the plate, this being subsequently sintered. It is likewise possible to sinter the plate as a whole and to separate it into bars with suitable parting processes (for example, cutting). After the bar is sintered, outside electrodes are applied to long sides of the bar. A precursor component is thus produced that can be further-processes in the aforementioned method to form an inventive electrical component.

This method has the advantage that the parallel manufacture of a great number of electrical components is enabled by manufacturing the plate of ceramic green films and electrode layers lying on top of one another.

The invention also specifies the employment of the electrical component as NTC resistor whose resistance amounts to between 50 and 500 Ohms at 25° Celsius. The employment of the component as a low-impedance temperature sensor thereby particularly comes into consideration. Due to the high sensitivity of the high-impedance ceramic that can be utilized in the inventive component, applications in the medical field are even possible, for example use in fever thermometers. It is precisely in fever thermometers that the temperature sensors employed therein must achieve a very high precision of <0.1 K when measuring the temperature. Further, the high manufacturing precision of the resistor is advantageous given such an employment. The inventive electrical component is particularly suited for NTC resistors with small dimensions since a large cross-sectional area of the resistor can be foregone due to the electrode layers.

In a preferred, exemplary embodiments, the present invention provides an electrical component whereby the B-value of the ceramic that describes the temperature curve ρ (T) of the specific resistance is greater than 4000 K. The base body has the shape of a cuboid that comprises four lateral surfaces that are free of electrically conductive coatings. The outside electrodes are applied onto the base body by a silk-screening process. In one embodiment, the electrical resistance of the component at 25° C. is less than 2 kΩ.

In the preferred component, the ceramic is a mixed crystal on the basis of $Mn_3O_4$ in spinel structure, perovskite structure or corundum structure with one or more additives selected from the elements nickel, cobalt, titanium, zirconium or aluminum. Each outside electrode is contacted to electrode layers in the form of planar layers lying parallel above one another that form a comb-like electrode packet with the respective outside electrode; and whereby the electrode packets are pushed into one another. The electrode layers may contain gold, palladium or platinum. Further, the outside electrodes may be composed of a silver or gold stoving paste. A lead can be soldered to each outside electrode.

In a preferred method, the precursor component is produced from a plate that is a layer stack of ceramic green films and suitably arranged electrode layers, comprising the following steps: punching a bar from the plate, sintering the bar, and applying outside electrodes onto long sides of the bar.

The precursor component may be produced from a plate that is a layer stack of ceramic green films and suitably arranged electrode layers, comprising the following steps: sintering the plate, cutting a bar from the plate, and applying outside electrodes onto long sides of the bar.

The present invention provides for employment of the component as an NTC resistor whose resistance at 25° amounts to between 50 and 500Ω. In the component, each lead is coated with gold and that comprises a protective envelope of glass.

Although other modifications and changes may be suggested by those skilled in the art, it is the intention of the inventors to embody within the patent warranted hereon all changes and modifications as reasonably and properly come within the scope of their contribution to the art.

We claim:

1. A method for manufacturing an electrical component with a predetermined rated resistance proceeding from a precursor component having a bar-shaped base body, outside electrodes arranged at long sides of the bar whose actual resistance measured between the outside electrodes is lower than the rated resistance, and wherein a resistance of longitudinal sections of the precursor component that are equal in length and comprise outside electrodes is of the same size, comprising the following steps:

a) measuring an actual resistance of the precursor component;

b) calculating a rated length of a longitudinal section of the precursor component representing an electrical component to be manufactured that is necessary for achieving the rated resistance; and c) cutting off a longitudinal section having the rated length from the precursor component.

2. A method according to claim 1, further comprising the steps of;

producing the precursor component from a plate that is a layer stack of ceramic green films and suitably arranged electrode layers;

punching a bar from the plate;

sintering the bar; and applying outside electrodes onto long sides of the bar.

3. A method according to claim 1, further comprising the steps of:

producing the precursor component from a plate that is a layer stack of ceramic green films and suitably arranged electrode layers;

sintering the plate;

cutting a bar from the plate; and applying outside electrodes onto long sides of the bar.

* * * * *